US007810895B2

(12) United States Patent
Yamada

(10) Patent No.: US 7,810,895 B2
(45) Date of Patent: Oct. 12, 2010

(54) INK JET RECORDING HEAD AND INK JET RECORDING APPARATUS

(75) Inventor: Hiroshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 976 days.

(21) Appl. No.: 11/563,646

(22) Filed: Nov. 27, 2006

(65) Prior Publication Data

US 2007/0120887 A1 May 31, 2007

(30) Foreign Application Priority Data

Nov. 29, 2005 (JP) ..... 2005-344367

(51) Int. Cl.
*B41J 2/205* (2006.01)

(52) U.S. Cl. ..... 347/15; 347/40; 347/43

(58) Field of Classification Search ..... 347/9, 347/12, 20, 40–43, 47, 15, 100
See application file for complete search history.

(56) References Cited

U.S. PATENT DOCUMENTS 6,665,091 B1 * 12/2003 Saruta ..... 358/1.5
2002/0196309 A1 12/2002 Murakami et al.

FOREIGN PATENT DOCUMENTS

JP 2000-141714 5/2000

* cited by examiner

*Primary Examiner*—Thinh H Nguyen
(74) *Attorney, Agent, or Firm*—Canon USA Inc IP Div

(57) ABSTRACT

An ink jet recording head configured to perform recording by discharging at least two types of ink onto a recording medium while scanning the recording medium. The head includes a first discharge port group and a second discharge port group configured to discharge a first ink, and a third discharge port group and a fourth discharge port group configured to discharge a second ink different from the first ink. The fourth discharge port group discharges a smaller amount of ink at a time from a single discharge port than the third discharge port group, the second discharge port group discharges a smaller amount of ink at a time from a single discharge port than the first discharge port group. The fourth discharge port group discharges a smaller amount of ink at a time from a single discharge port than the first discharge port group, and discharges a larger amount of ink at a time from a single discharge port than the second discharge port group.

7 Claims, 13 Drawing Sheets

INK JET RECORDING HEAD AND INK JET RECORDING APPARATUS

BACKGROUND OF THE INVENTION

1. Field of the Invention

The present invention relates to an ink jet recording head used for a recording apparatus in which a liquid ink or the like is discharged on a recording medium and to an ink jet recording apparatus.

2. Description of the Related Art

Generally, in accordance with the increase in recording speed, the number of discharge ports of an ink jet recording head for each ink color has increased to 128 or 256. These discharge ports are arranged so as to realize a high density recording of 300 dpi (dots per inch, a number of dots produced in 1 inch) or 600 dpi, etc. A heating device (i.e., an electrothermal conversion device) provided at the discharge port responds to a pulse drive of several to several tens of microseconds to form a bubble by film boiling. Since the heating device is driven by high-frequency, high-speed printing with high-image quality can be achieved.

In order to achieve high-quality color recording equivalent to that of silver halide photo by using an ink jet recording head, it is necessary to make dots extremely small to an unnoticeable level (i.e., no grainy effect is observed). A droplet of color ink used for ink jet recording has become so small, to approximately 5 pl (picoliter, $10^{-12}$ liter) to 2 pl which enables print resolution of 600×1200 dpi to 1200×1200 dpi.

In order to implement a recording head which can form a high gradient image with fine-image quality employing dots of different sizes, US Patent Application No. 2002/196309 discloses a recording head which has more nozzles for discharging small dots than those for discharging large dots. Japanese Patent Application Laid-open No. 2000-141714 also discloses a technique for down-sizing a head without significantly sacrificing image quality or print speed by reducing only the number of nozzles for yellow color and by lowering print resolution for yellow.

As described above, when an image is formed only by large ink drops, it is difficult to obtain high-quality image prints due to grainy images. By making the ink drops smaller, high-quality image printing with no grainy images can be obtained.

However, when the discharge port is made smaller to obtain the fine ink droplet, an amount of ink mist increases compared to a case where a larger dot is used. The ink mist is a plurality of fine ink droplets, called a satellite which is discharged from the discharge port of the recording head together with the main ink drop, or extremely small droplets of spattered ink which are produced when the main drop hits a recording medium.

Smaller ink droplets increase the amount of ink mist, thereby the ink mist can adhere to the discharge port of the recording head. The adhering ink mist produces an ink pool at the discharge port of the head, which may result in discharge failure (see FIG. 17). Especially when high-duty discharge is performed, viscous air at the discharge port group is pulled along with the discharge of the ink drop from the discharge port onto the recording medium.

As a result, pressure in the vicinity of the discharge port becomes lower than that at the periphery of the recording medium, and the air at the periphery flows into the low-pressure area (in the vicinity of the discharge port area), so that airflow can rise from the recording medium. Due to this airflow, a large amount of mist adheres to the discharge port and can cause discharge failure. Further, an error can also occur due to an increased amount of ink mist adhering to a sensor or a scale which is used in detecting the position of a carriage mounted with the recording head.

In addition, when the ink droplet becomes so fine, a large amount of ink is required in order to print an image compared to a case where a large dot is used since the image area has to be covered with fine dots.

An example of a conventional recording head includes the same discharge port configuration for each color of cyan, magenta, or yellow ink with large and small discharge ports as shown in FIG. 18.

FIG. 19 is a graph showing ink color in relation to the number of dots printed on a recording medium when printing a portrait photo, a popular item for ink jet printers, by using the conventional recording head. In FIG. 19, 2 pl corresponds to a small discharge port and 10 pl to a large discharge port.

A photo-quality print has a large image area that is printed with small dots discharged from small discharge ports to make the dots unnoticeable, i.e. without grains. If small dots are used to cover a certain size of a recording medium, a greater number of them is required as compared to a case where larger dots are used. Therefore, the number of small dots discharged from small discharge ports tends to increase. Additionally, since a yellow ink, which is brighter than other inks, is frequently used in printing lighter areas of an image such as human skin, the number of yellow dots discharged from small discharge ports further increases.

A recording head provided with the small discharge port discharges a greater number of dots as compared to discharges made by only a large port, and an electrothermal conversion element (i.e., a heating device) heated each time the port discharges. Not all the thermal energy generated by the heating device is converted to blowing energy and some of the energy tends to accumulate in the recording head. The head temperature rises accordingly.

Once the head temperature reaches a certain level due to continuous ink discharge, viscosity of the ink lowers and the bubble size becomes larger than the appropriate size. Then, the discharge becomes unstable which could cause phenomena such as a streak or an uneven print. Conventional techniques therefore reduce the print speed according to the rise in head temperature, however, such technique hinders improvement of throughput.

Further, since the amount of discharged ink increases as the ink droplet becomes small, there is concern about mechanical damage to the electrothermal conversion element due to cavitation produced by repeated bubbling and debubbling of ink. Besides, repeated application of pulse energy generates heat which can damage the heating device of the electrothermal conversion element. This causes discharge failure that leads to white streaks.

SUMMARY OF THE INVENTION

The present invention is directed to a recording head capable of avoiding discharge failure or error in a recording apparatus body by suppressing generation of ink mist and also capable of performing high-quality image printing without reducing print speed by controlling head temperature.

According to an aspect of the present invention, an ink jet recording head is configured to perform recording by discharging at least two types of ink onto a recording medium while scanning the recording medium. The head includes a first discharge port group and a second discharge port group each arranged in a row configured to discharge a first ink; and a third discharge port group and a fourth discharge port group configured to discharge a second ink of a type different from the first ink. The fourth discharge port group discharges from each discharge port an amount of ink at a time that is smaller than from each discharge port of the third discharge port group. The second discharge port group discharges from each discharge port an amount of ink at a time that is smaller than from each discharge port of the first discharge port group. The fourth discharge port group discharges from each discharge port an amount of ink at a time that is smaller than from each discharge port of the first discharge port group, and discharges an amount of ink at a time that is larger than from each discharge port of the second discharge port group.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1A:
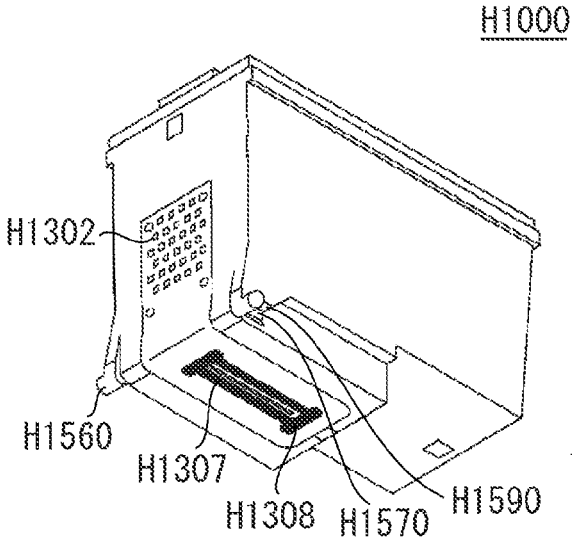
FIGS. 1A and 1B are perspective views of a first recording head according to an exemplary embodiment of the present invention.
Figure 1B:
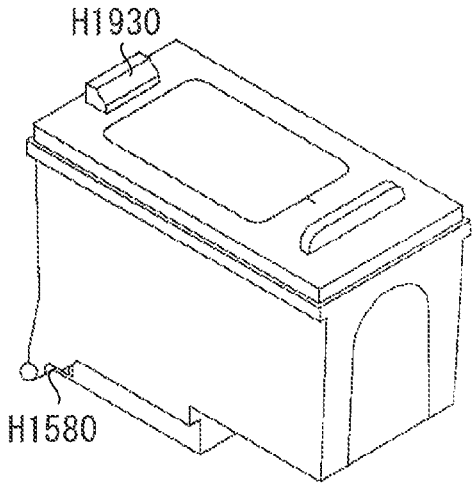
Figure 4A:
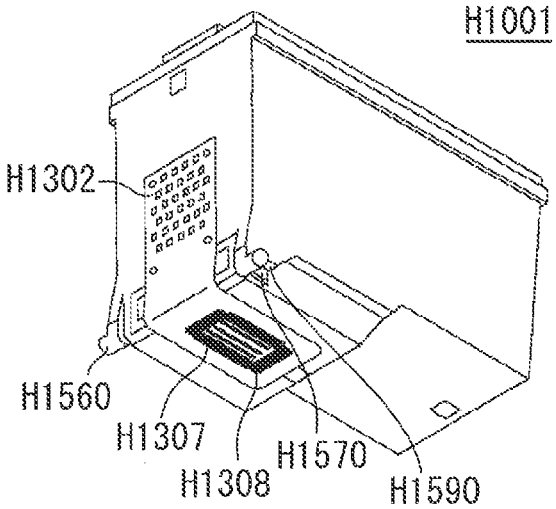
FIGS. 4A and 4B are perspective views showing a second recording head according to an exemplary embodiment of the present invention.
Figure 4B:
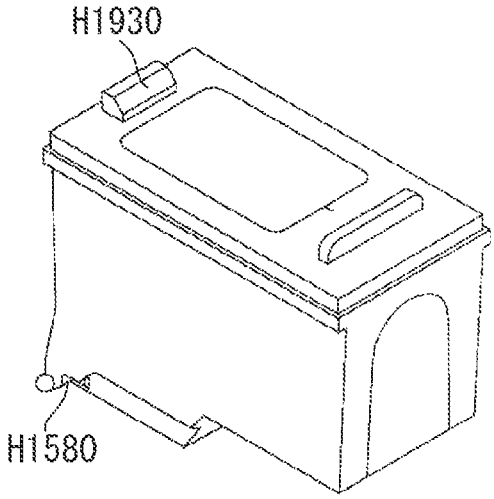

A recording head according to an exemplary embodiment of the present invention integrates an ink tank as illustrated in FIGS. 1A, 1B, 4A, and 4B. FIGS. 1A and 1B illustrate a first recording head H1000 mounted with a black ink tank. FIGS. 4A and 4B illustrate a second recording head H1001 mounted with a color ink tank (cyan ink, magenta ink, yellow ink) or a photo ink tank (light cyan ink, light magenta ink, black ink).

The recording heads H1000 and H1001 are fixed and supported by an electric contact point and a carriage positioning unit arranged on an ink jet recording apparatus body. When ink is consumed, the recording head is removed from the carriage for replacement.

Each of the components comprising the above-mentioned recording head will now be described in detail.

[Recording Head]

The first recording head H1000 and the second recording head H1001 can be bubble-jet type recording heads including an electrothermal conversion device which generates thermal energy used for film boiling of ink according to an electric signal. They are classified as a so-called side-shooter type recording head whose electrothermal conversion device is arranged to be opposed to an ink discharge port.

First Recording Head

Figure 2A:
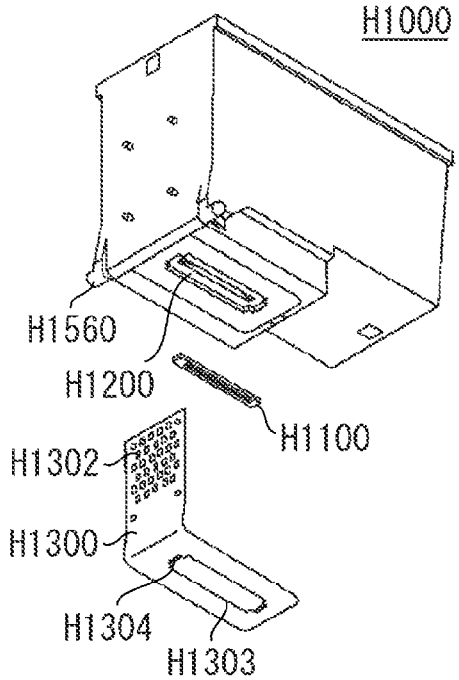
FIGS. 2A and 2B are exploded perspective views showing the first recording head according to an exemplary embodiment of the present invention.
Figure 2B:
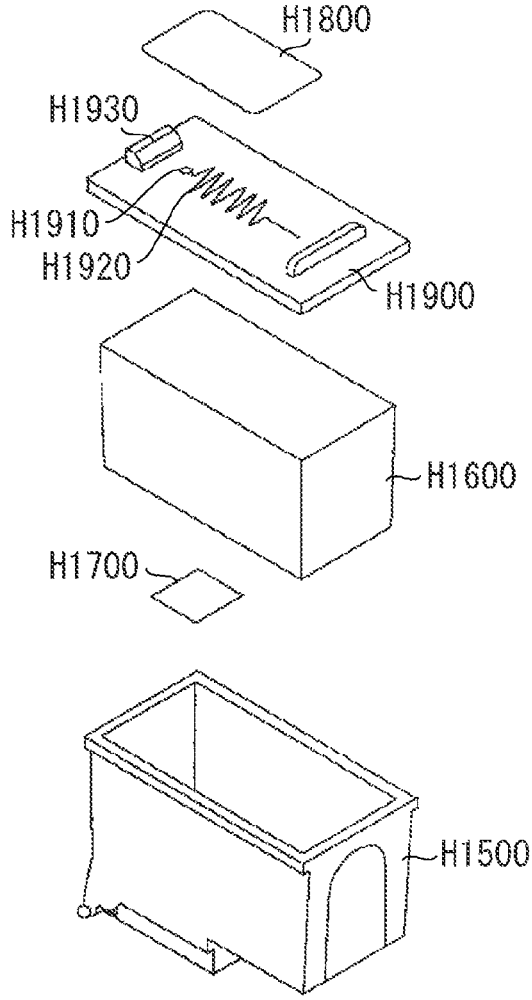

The first recording head H1000 is designed for a black ink. FIGS. 2A and 2B are exploded perspective views showing the first recording head H1000.

The first recording head H1000 includes a recording element substrate H1100, an electric wiring tape H1300, an ink supply holding member H1500, a filter H1700, an ink absorber H1600, a cap member H1900, and a seal member H1800.

First Recording Element Substrate

Figure 3:
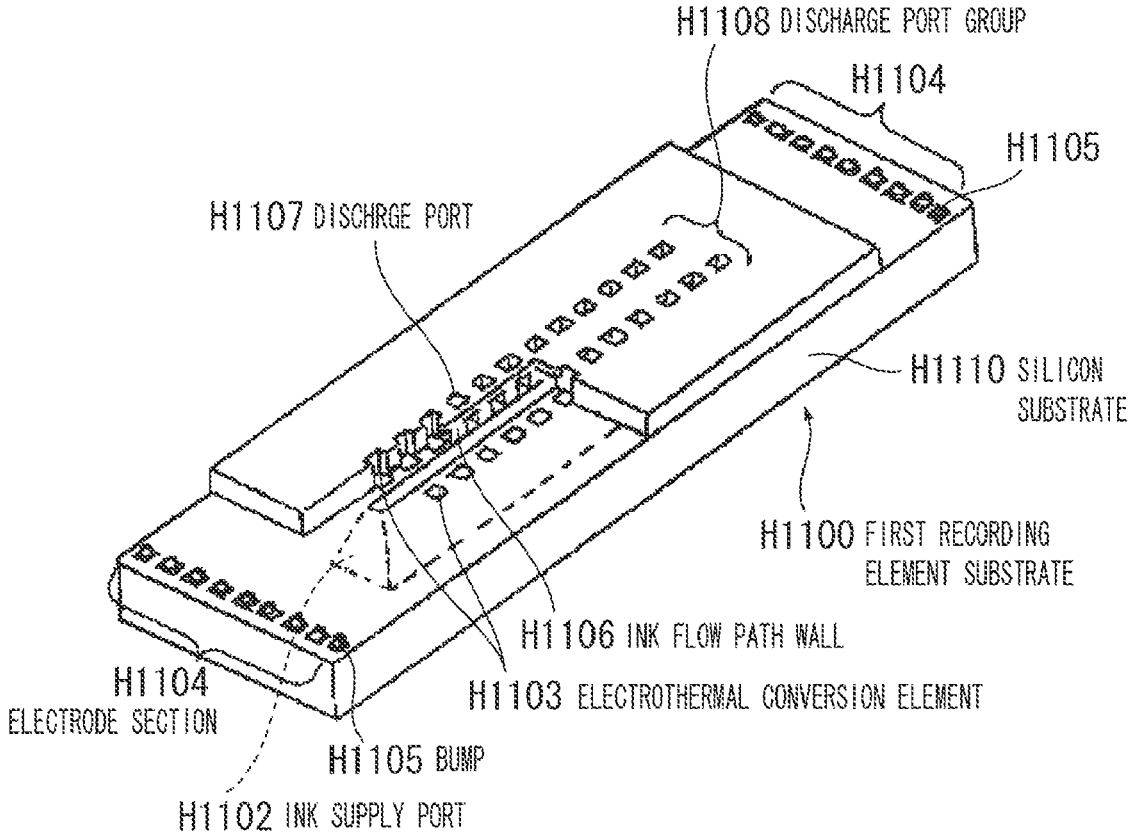
FIG. 3 is a perspective view showing a first recording element substrate according to an exemplary embodiment of the present invention with a part of the structure omitted.

FIG. 3 is a perspective view showing a configuration of the first recording element substrate H1100 with a part of the structure omitted. The first recording element substrate H1100 is based on a silicon substrate H1110 having a thickness of about 0.5 to 1 mm. An ink supply port H1102 for the flow-through ink, can be formed by anisotropic etching using crystal orientation of silicon or sand blasting.

On each side of the ink supply port H1102, electrothermal conversion elements H1103 are aligned in a row. Further, electric wirings (not shown) of aluminum or the like for providing electric power to the electrothermal conversion elements H1103 are provided.

The electrothermal conversion elements H1103 and the electric wirings are formed by film forming technique. The electrothermal conversion elements H1103 are arranged in a staggered manner so that each discharge port in a row does not align with a discharge port of the other row in a direction perpendicular to the row direction. Further, an electrode section H1104 for supplying electric power to the electric wiring or supplying electric signal to drive the electrothermal conversion element H1103 is formed along both sides of the outer ends of the electrothermal conversion element H1103. Bumps H1105 of Au or the like are formed on the electrode section H1104.

Figure 7:
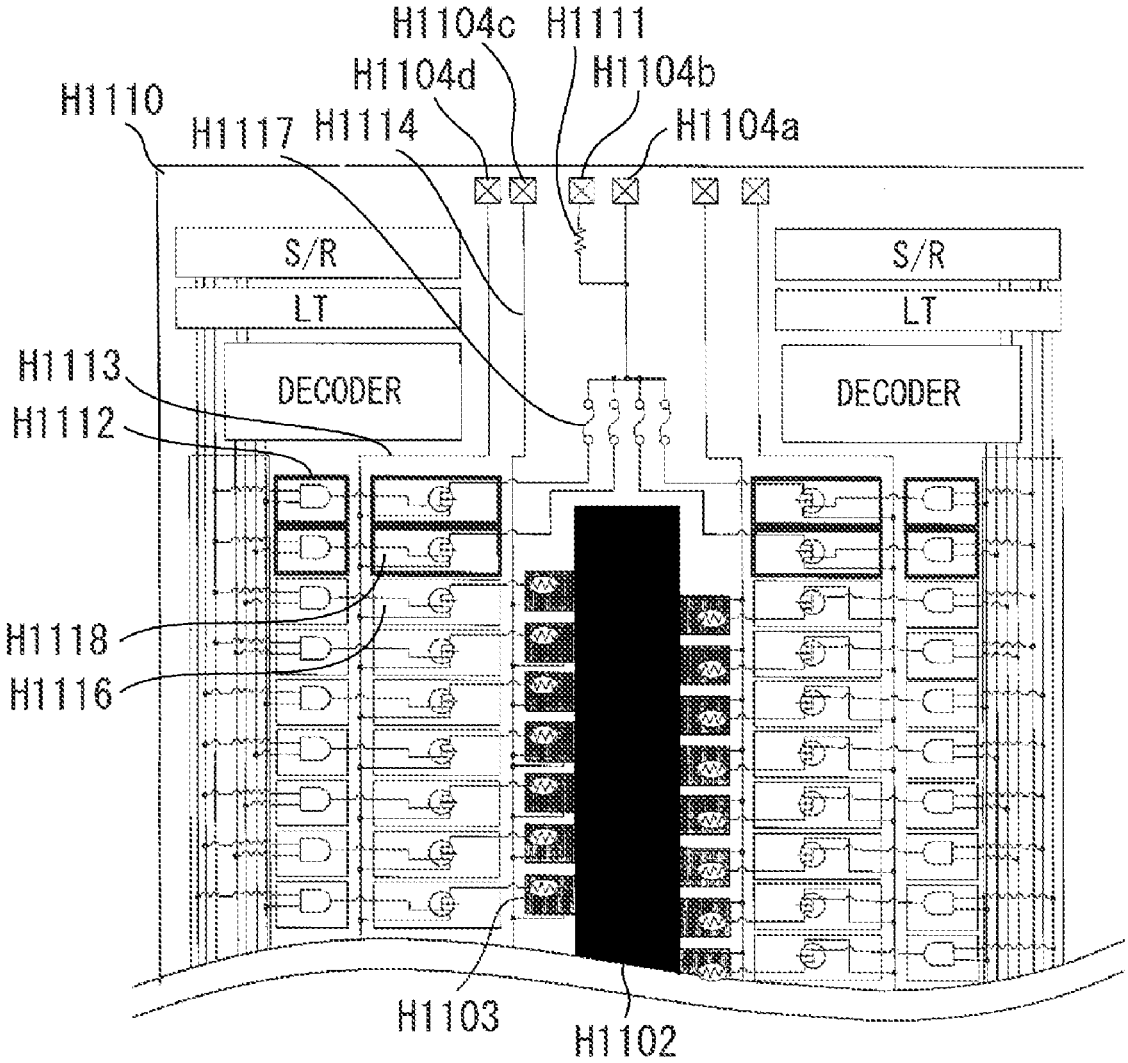
FIG. 7 is a schematic plan view of a Si substrate portion.

The Si substrate H1110 further includes a fuse H1117 for storing head-specific information. FIG. 7 is a schematic diagram of the Si substrate H1110. The fuse H1117 can be a polysilicon resistor arranged at the shorter side of the ink supply port according to the present exemplary embodiment. A second drive element H1118 which burns out the fuse H1117 and reads out signals is arranged adjacent to a first drive element H1116.

A signal which is used in selecting the electrothermal conversion element H1103 is also used as a selection signal for the second drive element H1118 to selectively drive the fuse H1117. Therefore, the selection signal is selected in the same manner as when the electrothermal conversion element H1103 is selected. More specifically, components from a signal line carrying a signal received by the ink jet recording substrate, to the vicinity of the second drive element H1118 through a shift register, a latch circuit and a decoder, are driven by the same circuit as used in selecting the first drive element H1116. The first drive element H1116 drives the electrothermal conversion element H1103.

A selection circuit H1112 which finally selects the second drive element H1118 according to a signal output from a shift register is similar to the circuit for the first drive element H1116. Additionally, a VH power supply line H1114 is connected to the electrothermal conversion element H1103 to supply VH power. This VH power supply line H1114 extends from a VH power supply pad H1104*c*.

A GNDH power supply line H1113 for supplying GNDH power is shared by the first drive element H1116 connected to the electrothermal conversion element H1103 and the second drive element H1118 connected to the fuse H1117. The GNDH power supply line H1113 extends from a GNDH power supply pad H1104*d*.

An ID pad H1104*a* functions as a fuse disconnection terminal that applies voltage when the fuse H1117 is burnt while it functions as a signal output terminal during readout of information. This means that when the fuse is to be disconnected, a voltage (e.g., 24V, a voltage for driving element) is applied to the ID pad H1104*a*, which drives the second drive element H1118 selected by the selection circuit, and the corresponding fuse H1117 is burnt and disconnected instantaneously. At that time, an ID power pad H1104*b*, which is a fuse readout power terminal, is opened. On the other hand, at the time of readout, by applying voltage (e.g., 3.3 V, power supply voltage of logic circuit) to the ID power pad H1104*b*, a signal is output to the ID pad H1104*a*. Therefore, if the fuse H1117 is disconnected, a Hi level is input to the ID pad H1104*a*, if not, a Lo level is input to the ID pad H1104*a* from a readout resistor H1111. The resistance of the readout resistor H1111 is apparently greater than the fuse H1117.

On the Si substrate H1110 having such patterns, there are provided an ink channel wall (ink flow path wall) H1106 that forms an ink channel corresponding to the electrothermal conversion element H1103, and an overhead part covering the upper part thereof. The overhead part includes a structure made of resin with an opening (i.e., a discharge port H1107) formed by photolithography.

The discharge ports 1107 oppose the electrothermal conversion elements H1103 and constitute a discharge port group H1108. In the first recording element H1100, ink supplied from the ink supply port H1102 is discharged from the discharge ports 1107 by a pressure of a bubble produced by heat which is generated from each of the electrothermal conversion elements H1103. The discharge ports 1107 oppose each electrothermal conversion elements H1103 respectively.

Electric Wiring Tape

The electric wiring tape H1300 forms an electric signal path used in sending electric signals to discharge ink to the first recording element substrate H1100. The electric wiring tape H1300 includes an opening H1303 used for incorporating the recording element substrate H1100. At the circumference of the opening H1303, an electrode terminal H1304 is provided, which is connected to the electrode section H1104 of the recording element substrate H1100. The electric wiring tape H1300 also includes external signal input terminals H1302 for receiving electric signals from the recording apparatus. The electrode terminal H1304 and the external signal input terminals H1302 are connected by continuous copper-foil wiring patterns.

As an example of an electrical connection of the electric wiring tape H1300 and the first recording element substrate 1100, the bump H1105 is formed on the electrode section H1104 which can be electrically connected to the electrode terminal H1304 of the electric wiring tape H1300 by a thermosonic crimping method.

Ink Supply Holding Member

The ink supply holding member H1500 is formed, for example, by mold resin. The resin material can contain glass filler in the range of 5% to 40% to enhance rigidity in terms of shape. As shown in FIG. 2B, the ink supply holding member H1500 includes the absorber H1600 for holding each ink therein and producing negative pressure. With this configuration, the ink supply holding member H1500 functions as an ink tank. Further, an ink channel is provided on the recording element substrate H1100 so that the ink supply holding member H1500 also functions as an ink supplier.

The absorber H1600 can be a compressed fiber of polypropylene (PP), or a compressed fiber of urethane can also be used. Upstream of the ink channel at the border between the ink supply holding member H1500 and the ink absorber H1600, the filter H1700 is welded and bonded to prevent dust from contaminating the recording element substrate H1100. The filter H1700 can be a SUS mesh or a SUS fiber sintered filter.

At a downstream of the ink channel, an ink supply port H1200 is provided to supply black ink to the first recording element substrate H1100. The first recording element substrate H1100 adheres and is affixed with accuracy to the ink supply holding member H1500 so that the ink supply port H1102 of the first recording element substrate H1100 communicates with the ink supply port H1200 of the ink supply holding member H1500. A first adhesive employed in this adhesion can be a low-viscosity type adhesive which cures at a low temperature in a short time, stays relatively hard after cure, and is furthermore ink-resistant. As the first adhesive, a thermosetting adhesive whose principal component is epoxy resin can be used. Its bonding layer thickness is can be about 50 μm.

Figure 8:
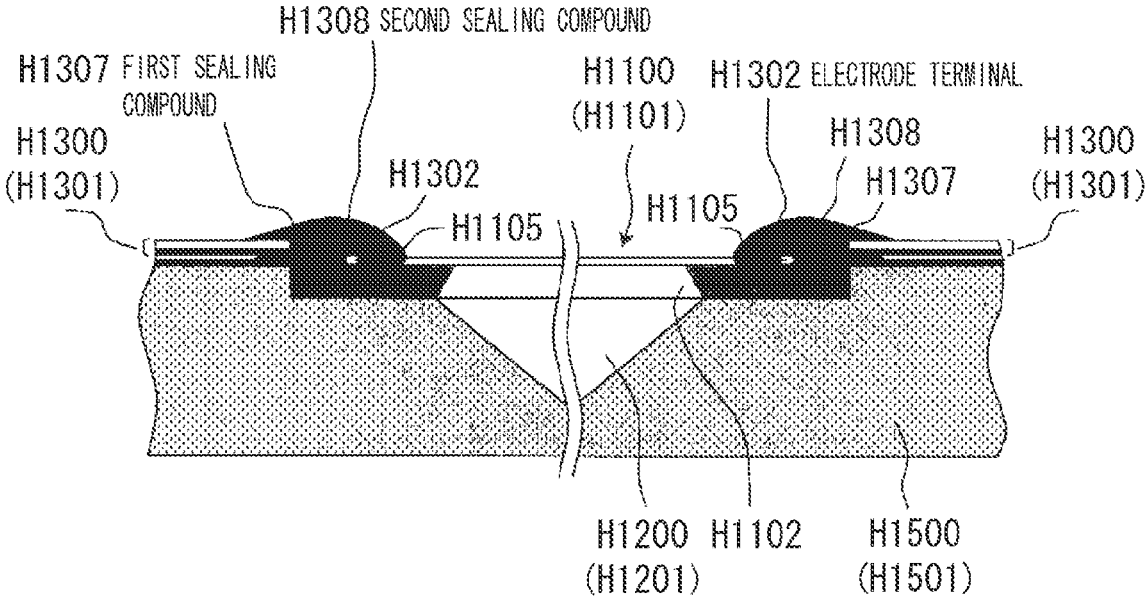
FIG. 8 is a partial cross-section view of a recording head.

Further, a part of the back side of the electric wiring tape H1300 adheres and is affixed to a periphery of an adhesive area of the first recording element substrate H1100 by a second adhesive. The electric connection area connecting the first recording element substrate H1100 and the electric wiring tape H1300 is sealed with a first sealing compound H1307 and a second sealing compound H1308 (see FIG. 8) to protect the area from corrosion by ink, or from external impact. The first sealing compound H1307 mainly seals the back side of an area connecting the electrode terminal H1302 of the electric wiring tape H1300 and the bump H1105, and also seals an outer periphery of the recording element substrate 1100. The second sealing compound H1308 seals the face side of the above-mentioned connection area. The non-adhesive area of the electric wiring tape H1300 is bent, then fixed by thermal caulking or adhesion to a side of the ink supply holding member H1500 substantially perpendicular to the adhesive area of the first recording element substrate H1100.

Cap Member

The cap H1900 is welded and fixed to the upper opening of the ink supply holding member H1500 so as to keep the ink supply holding member H1500 internally air-tight. However, the cap H1900 includes a narrow mouth H1910 configured to let internal fluctuating pressure of the ink supply holding member H1500 to escape, and a fine-cut groove H1920 connected thereto. While most part of the narrow mouth H1910 and the fine-cut groove H1920 is covered with the seal member H1800, one end of the fine-cut groove H1920 is opened to form an air communication opening. Further, the cap H1900 includes an engagement portion H1930 provided to secure the first recording head H1100 to the ink jet recording apparatus.

Second Recording Head

The second recording head H1001 discharges three colors of cyan, magenta, and yellow, or light cyan, light magenta, and black ink onto a recording medium.

Figure 5A:
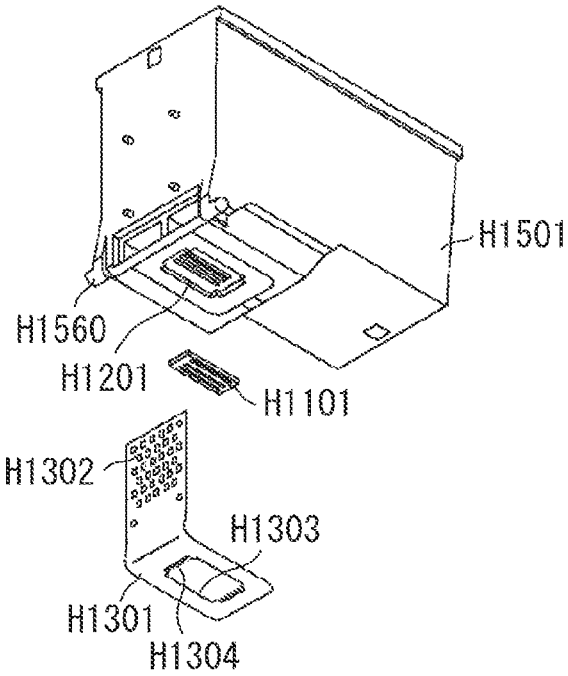
FIGS. 5A and 5B are exploded perspective views showing a decomposition of the second recording head according to an exemplary embodiment of the present invention.
Figure 5B:
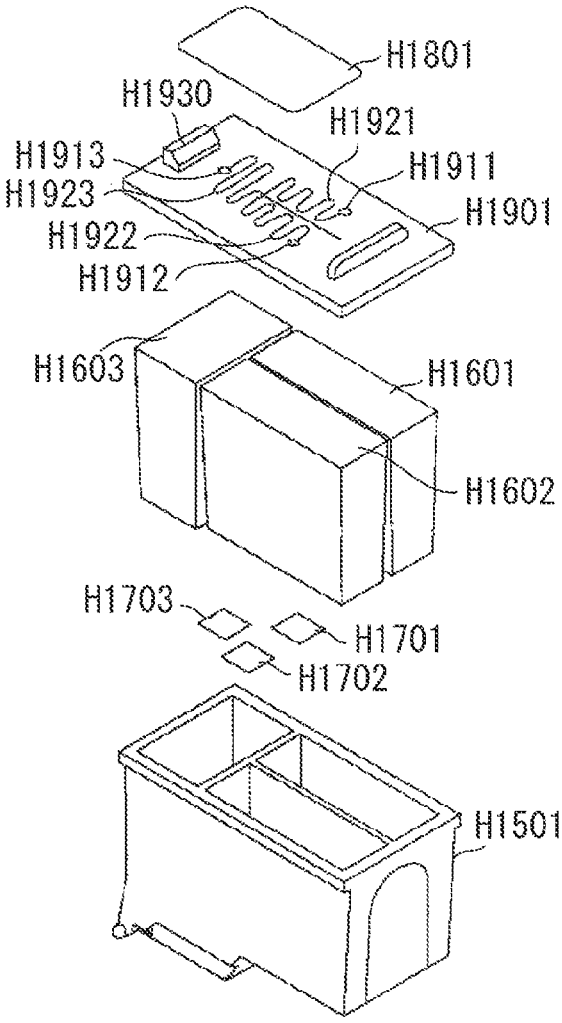

FIGS. 5A and 5B are exploded perspective views of the second recording head H1001. The second recording head H1001 includes a recording element substrate H1101, an electric wiring tape H1301, and an ink supply holding member H1501. Further, the second recording head H1001 includes filters H1701 to H1703, ink absorbers H1601 to H1603, a cap H1901, and a seal H1801.

Second Recording Element Substrate

Figure 6:
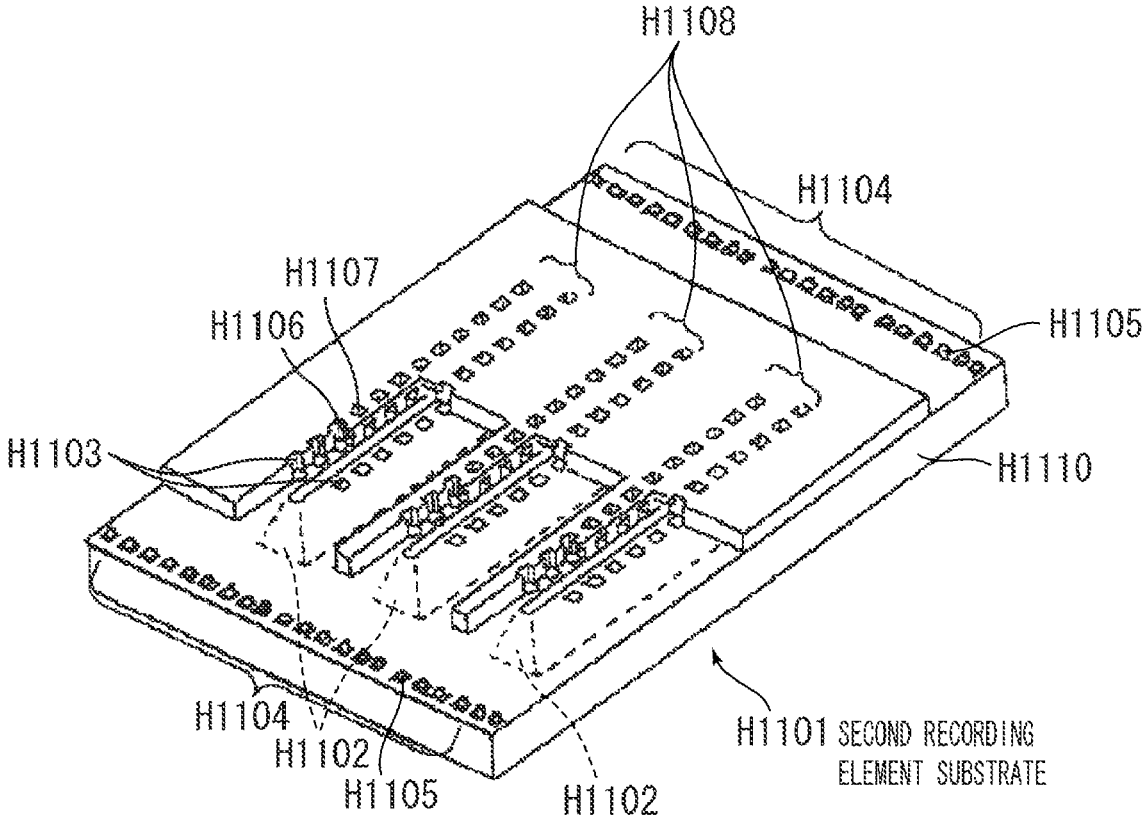
FIG. 6 is a perspective view showing a second recording element substrate according to an exemplary embodiment of the present invention with a part of the structure omitted.

FIG. 6 is a perspective view showing a configuration of the second recording element substrate H1101 with a part of the structure omitted. The second recording element substrate H1101 has three ink supply ports H1102 arranged parallel to each other. On both sides of the ink supply ports H1102, electrothermal conversion elements H1103 and discharge ports H1107 are arranged in rows in a staggered manner. Similar to the Si substrate H1110 and the first recording element substrate H1100, the Si substrate H1101 has an electric wiring, a fuse, an electrode section H1104 provided thereon. Over such components, an ink channel wall H1106 and the discharge port H1107 are formed with resin by photolithography. The electrode section H1104 has a bump H1105 of Au or the like.

Electric Wiring Tape

The electric wiring tape H1301 forms an electric signal path which sends electric signals to discharge ink to the second recording element substrate H1101. The electric wiring tape H1301 includes an opening H1303 used for incorporating the recording element substrate. At the circumference of the opening H1303, an electrode terminal H1304 is provided which is connected to the electrode section H1104 of the recording element substrate H1101. The electric wiring tape H1301 also includes the external signal input terminal H1302 for receiving electric signals from the recording apparatus. The electrode terminal H1304 and the external signal input terminal H1302 are connected by continuous copper-foil wiring patterns.

In order to connect the electric wiring tape H1301 and the second recording element substrate 1101, for example, the bump H1105 formed on the electrode section H1104 can be electrically connected to the electrode terminal H1304 of the electric wiring tape H1301 which corresponds to the electrode section H1104, by the thermosonic crimping method.

Ink Supply Holding Member

The ink supply holding member H1501 is formed, for example, by mold resin. The resin material can contain glass filler in the range of 5% to 40% to enhance rigidity in terms of shape.

As shown in FIGS. 5A and 5B, the ink supply holding member H1501 includes a space where absorbers H1601, H1602, and H1603 are held separately. These absorbers generate negative pressure to hold each ink. According to this configuration, the ink supply holding member H1501 functions as an ink tank. Further, the ink supply holding member H1501 functions as an ink supplier and includes independent ink channels which guide each color ink into the ink supply port H1102 of the recording element substrate H1101.

As a material of the absorbers H1601, H1602, and H1603, a compressed fiber of polypropylene is used, but a compressed fiber of urethane can also be alternatively used. Upstream of the ink channel at the border between the ink supply holding member H1501 and the absorbers H1601 to H1603, the filters H1701 to H1703 are welded and fixed to prevent dust from contaminating the recording element substrate H1101. The filters H1701, H1702, and H1703 can be a SUS mesh, but an SUS fiber sintered filter can alternatively be used.

At a downstream of the ink channel, an ink supply port H1201 is provided to supply each ink to the second recording element substrate H1101. The second recording element substrate H1101 adheres and is affixed with accuracy to the ink supply holding member H1501 so that each ink supply port H1102 of the second recording element substrate H1101 communicates with corresponding ink supply port H1201 of the ink supply holding member H1501. A first adhesive employed in this adhesion can be a low-viscosity type adhesive which cures at a low temperature in a short time, stays relatively hard after cure, and ink-resistant. As the first adhesive, a thermosetting adhesive whose principal component is epoxy resin can be used. Its bonding layer thickness can be about 50 μm.

Further, a part of the back side of the electric wiring tape H1300 is affixed to a periphery of the ink supply port H1201 with a second adhesive. The electric connection area connecting the second recording element substrate H1101 and the electric wiring tape H1301 is sealed with a first sealing compound H1307 and a second sealing compound H1308 (see FIG. 8) to protect the electric connection area from corrosion by ink or from external impact. The first sealing compound H1307 mainly seals the back side of an area connecting the electrode terminal H1302 of the electric wiring tape H1301 and the bump H1105, and seals the outer periphery of the recording element substrate 1101. The second sealing compound H1308 seals the face side of the above-mentioned connection area. The non-adhesive area of the electric wiring tape H1301 is bent, and then fixed by thermal caulking or adhesion to a side substantially perpendicular to the side of the ink supply holding member H1501 having the ink supply port H1201.

Cap Member

The cap H1901 is welded and fixed to the upper opening of the ink supply holding member H1501 so as to keep each independent space of the ink supply holding member H1501 internally air-tight. However, the cap H1901 includes narrow mouths H1911, H1912, and H1913 configured to let internal fluctuating pressure of the ink supply holding member H1501 to escape, and fine-cut grooves H1921, H1922, and H1923 connected thereto. Other ends of both the fine-cut grooves H1921 and H1922 join the fine-cut groove H1923 at a certain point. While most part of the narrow mouths H1911, H1912, and H1913 and the fine-cut grooves H1921, H1922, and H1923 are covered with the seal H1801, one end of the fine-cut groove H1923 is opened to form an air communication opening. Further, the cap H1901 includes an engagement portion H1930 provided to secure the second recording head H1101 to the ink jet recording apparatus.

Installation of Recording Head to Ink Jet Recording Apparatus

As shown in FIGS. 1A, 1B, 4A, and 4B, the first recording head H1000 and the second recording head H1001 are equipped with a installation guide H1560, the engagement portion H1930, abutting portions H1570, H1580, and H1590. The installation guide H1560 guides the recording head to the carriage installation position of the ink jet recording apparatus body. The engagement portion H1930 secures the recording head to the carriage with a head set lever. The abutting portion H1570 locates the recording head to a predetermined installation position of the carriage in the X-direction (carriage scan direction). The abutting portion H1590 functions similarly but in the Z-direction (ink discharge direction).

Since the recording head is positioned according to the above abutting portions, the external signal input terminal H1302 on the electric wiring tapes H1300 and H1301 reliably performs electrical contact with a contact pin provided on the electric connection area in the carriage.

[Ink Jet Recording Apparatus]

Figure 9:
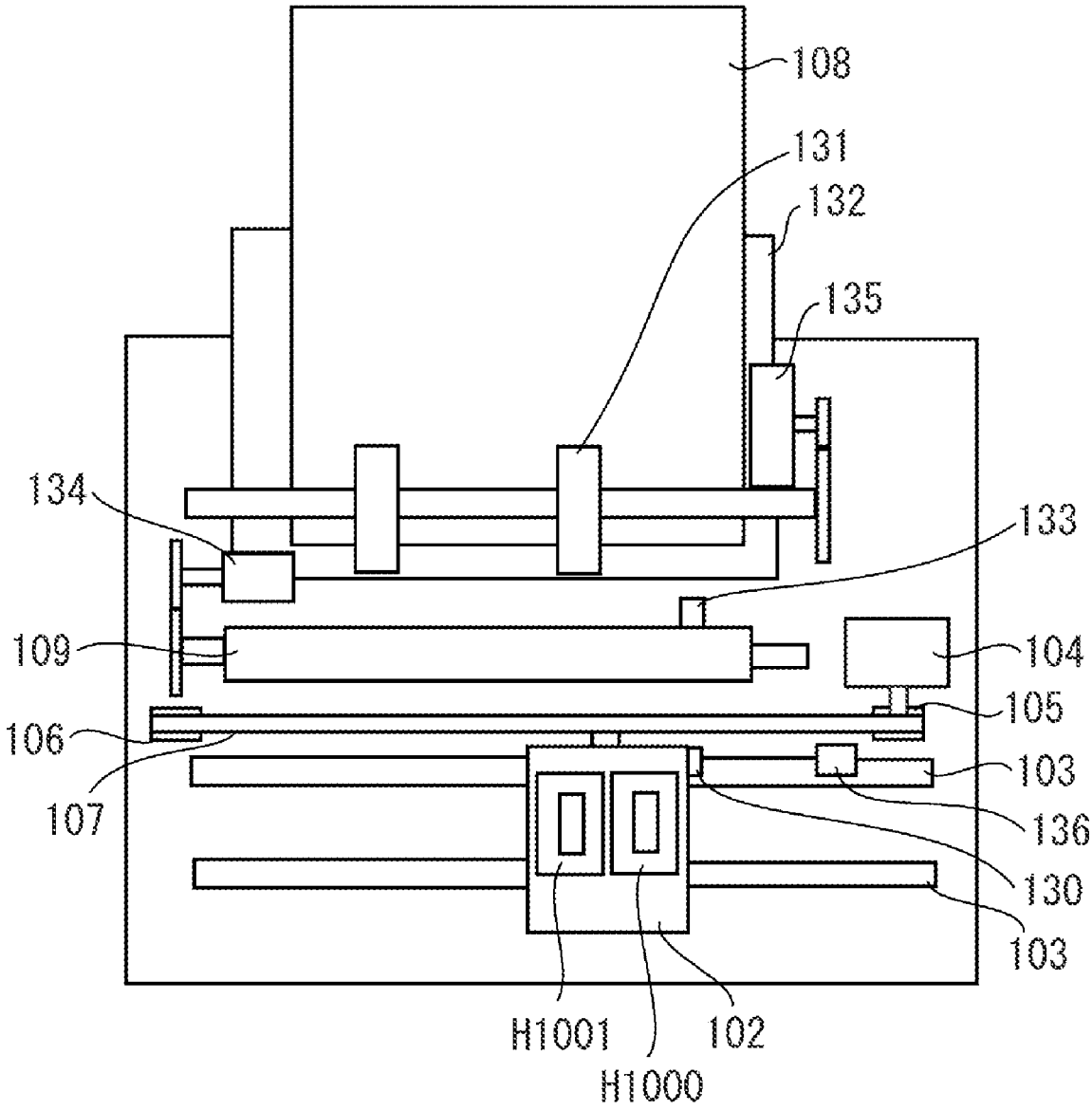
FIG. 9 illustrates an ink jet recording apparatus to which an ink jet recording head applicable according to an exemplary embodiment of the present invention.

Next, a liquid discharge recording apparatus mountable with the above-mentioned cartridge-type recording head will be described. FIG. 9 illustrates an example of a recording apparatus mountable with a liquid discharge recording head of the present invention.

The recording apparatus illustrated in FIG. 9 includes the recording heads H1000 and H1001 shown in FIGS. 1A, 1B, 4A, and 4B, which are replaceably positioned and mounted on the carriage 102. The carriage 102 has an electric connection section configured to send signals, such as a driving signal, to each discharge section through the external signal input terminal on the recording heads H1000 and H1001.

The carriage 102 is supported and guided along a guide shaft 103 in the apparatus body. The guide shaft 103 extends in the main scan direction in a linearly-reciprocating manner. The carriage 102 is operated and its position and movement are controlled by a drive mechanism including a motor pulley 105, a driven pulley 106, and a timing belt 107. The drive mechanism is driven by a main scan motor 104. Further, a home position sensor 130 is provided on the carriage 102. The location of a shield 136 is detected when the home position sensor 130 passes the shield.

A recording medium 108, (e.g., a sheet of print paper, a plastic sheet) is fed one by one from an auto sheet feeder (ASF) 132 by a pickup roller 131, which is rotated by a paper feeding motor 135 through a gear. Further, by rotation of a conveying roller 109, the recording medium 108 is carried (fed) through a position opposite to the discharge port area of the recording heads H1000 and H1001 (print section). The conveying roller 109 is rotated by a gear driven by an LF motor 134. A paper end sensor 133 determines whether a recording medium has been fed and defines the starting position at the time of paper feed when the recording medium 108 passes the sensor. The paper end sensor 133 also determines the current recording position by detecting an actual trailing edge of the recording medium 108.

Further, the recording medium 108 is supported by a platen (not shown) at the non-printing side so that a flat print surface can be provided at the print section. In this case, the recording heads H1000 and H1001 mounted on the carriage 102 are arranged projecting downward from the carriage 102 so that their discharge ports are parallel with the recording medium 108 between the two pairs of conveying rollers.

The recording heads H1000 and H1001 are mounted on the carriage 102 such that the discharge ports of each discharge section are disposed in a direction that crosses the above-mentioned scan direction of the carriage 102. Recording operation is performed by liquid discharged from these discharge port rows.

First Exemplary Embodiment

A first exemplary embodiment of a nozzle configuration of an ink jet recording head will be described referring to the second recording head.

Figure 10:
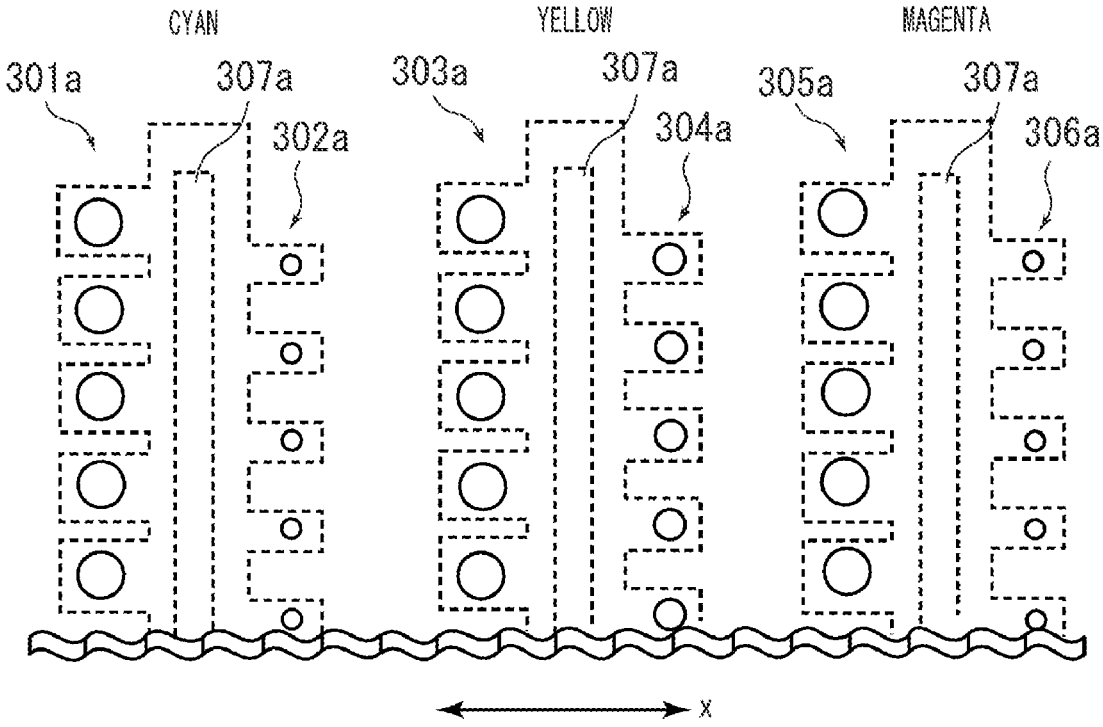
FIG. 10 illustrates a nozzle configuration of a recording head according to a first exemplary embodiment of the present invention.

As shown in FIG. 10, the nozzle of the recording head of the first exemplary embodiment is configured to have a plurality of discharge ports aligned in rows along the main scan direction (X-direction).

A first discharge port group 301*a* and a second discharge port group 302*a* oppose each other, a third discharge port group 303*a* and a fourth discharge port group 304*a* oppose each other, and a fifth discharge port group 305*a* and a sixth discharge port group 306*a* are aligned oppose each other, with each pair sandwiching an ink supply port 307*a* therebetween. The discharge ports of the first discharge port group 301*a* and the second discharge port group 302*a* discharge cyan ink. The discharge ports of the third discharge port group 303*a* and the fourth discharge port group 304*a* discharge yellow ink. The discharge ports of the fifth discharge port group 305*a* and the sixth discharge port group 306*a* discharge magenta ink.

The first discharge port group 301*a*, the third discharge port group 303*a*, and the fifth discharge port group 305*a* include discharge ports of a large diameter (hereinafter referred to as "large discharge port") disposed at regular intervals. According to the first exemplary embodiment, the large discharge port has a diameter of about 23 μm and discharges approximately 10 pl.

The second discharge port group 302*a* and the sixth discharge port group 306*a* include discharge ports of a small diameter (hereinafter referred to as "small discharge port") disposed at regular intervals. The small discharge port has a diameter of about 11.5 μm and discharges approximately 2 pl.

The fourth discharge port group 304*a* includes discharge ports of a middle-size diameter, smaller than the large discharge port but larger than the small discharge port (hereinafter referred to as "middle discharge port"), which are disposed at regular intervals. The fourth discharge port group 304*a* discharges yellow ink whose color is relatively brighter than cyan or magenta ink. The middle discharge port has a diameter of about 16.5 μm and discharges approximately 5 pl.

The first exemplary embodiment assigns yellow ink to the middle discharge port for the following reasons.

The middle discharge port is assigned to yellow ink instead of the large discharge port because its brightness is high so that it has the smallest grainy effect on the image as compared to cyan or magenta ink when a dot of the same size is recorded on a recording medium. If the same amount of yellow ink as that of a large discharge port is discharged, a grainy image can be noticed. The middle discharge port that does not show the grainy effect is therefore assigned to yellow ink.

In addition, the reason for assigning yellow ink to the middle discharge port instead of the small discharge port is because middle-size dots can cover an area with a smaller number of dots as compared to a case where smaller dots are used.

Figure 11:
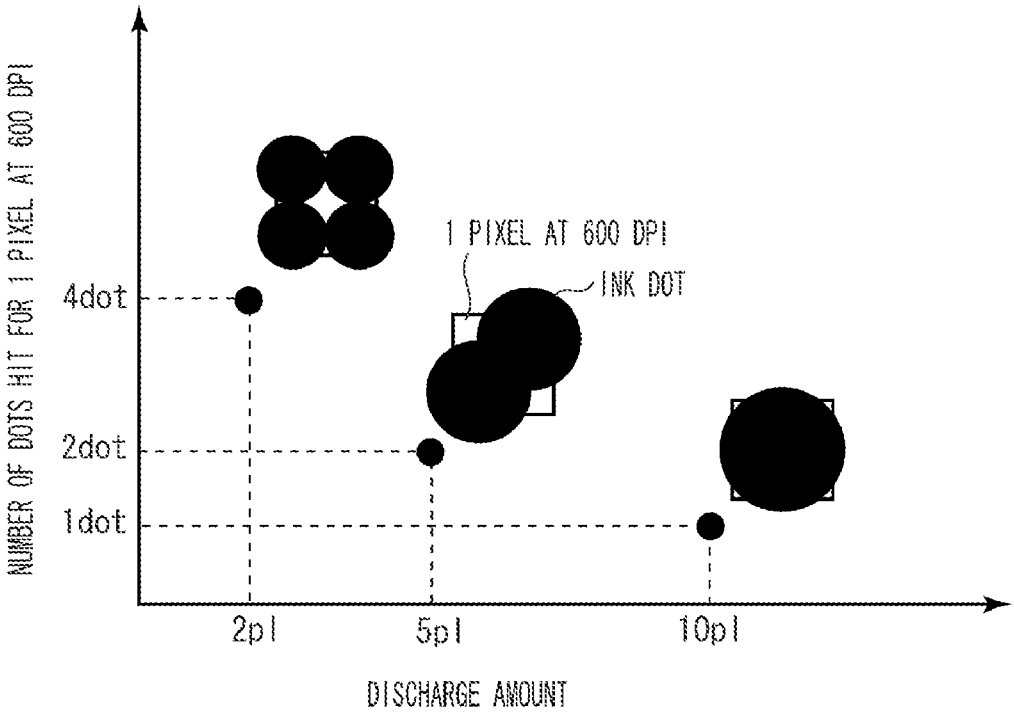
FIG. 11 is a graph showing a relationship between number of dots hit for 1 pixel at 600 dpi and amount of discharge.

FIG. 11 is a graph showing a correlation between the amount of discharge and the number of dots discharged to cover 1 pixel at 600 dpi. When the discharge amount is 10 pl, 1 dot is enough to cover 1 pixel, whereas 2 dots and 4 dots are necessary in the case of 5 pl and 2 pl. Since yellow ink is discharged from the middle discharge port which discharges 5 pl, the number of necessary dots will be half of that from a small discharge port. The small discharge port discharges 2 pl according to the first exemplary embodiment. This reduces the number of times the heating device is heated (to a half) and prevents head temperature from rising.

Since the amount of ink mist increases as the discharge amount decreases, the recording head of the first exemplary embodiment assigns yellow ink to the middle discharge port to reduce the ink mist. Consequently, the recording head of the first exemplary embodiment can prevent generation of a liquid pool that may cause discharge failure. The liquid pool is produced at the discharge port area of the head when a large amount of mist is accumulated. Further, since the amount of ink mist adhering to the components of the printer body such as a sensor or a scale is reduced, the possibility of errors in the apparatus body is also reduced.

As described above, due to the nozzle configuration of the first exemplary embodiment, the amount of ink mist can be reduced and discharge failure or error can be prevented. Further, the number of necessary dots can be reduced as compared to the case where the same image is printed using a conventional head. Accordingly, the number of times the heating device is heated is reduced, head temperature rise is controlled, continuous and stable ink discharge becomes possible, and desired print quality can be obtained. In addition, since the number of dots necessary in printing an image is reduced, the number of times the heating device is turned on is also reduced, which contributes to lowering the possibility that non-discharge of ink is caused by a broken wire, and increases the number of pages printable by a recording head.

Second Exemplary Embodiment

The second exemplary embodiment describes a photo-print recording head having a similar configuration to the color-print recording head described in the first exemplary embodiment but using a different type of ink in the ink cartridge. The description of the parts that are common to the first exemplary embodiment is omitted for simplification.

A photo-print recording head is generally mounted in place of the black-print recording head in the printer described in the first exemplary embodiment. When the recording heads for color-print and photo-print are used together, it becomes possible to print a high-definition image with no grainy images. Inks of light cyan, light magenta, and black are contained in the ink cartridge for the photo-print recording head. Dye-density of the light cyan and the light magenta inks is further reduced. The black ink described in this embodiment is a dye-based ink.

Figure 12:
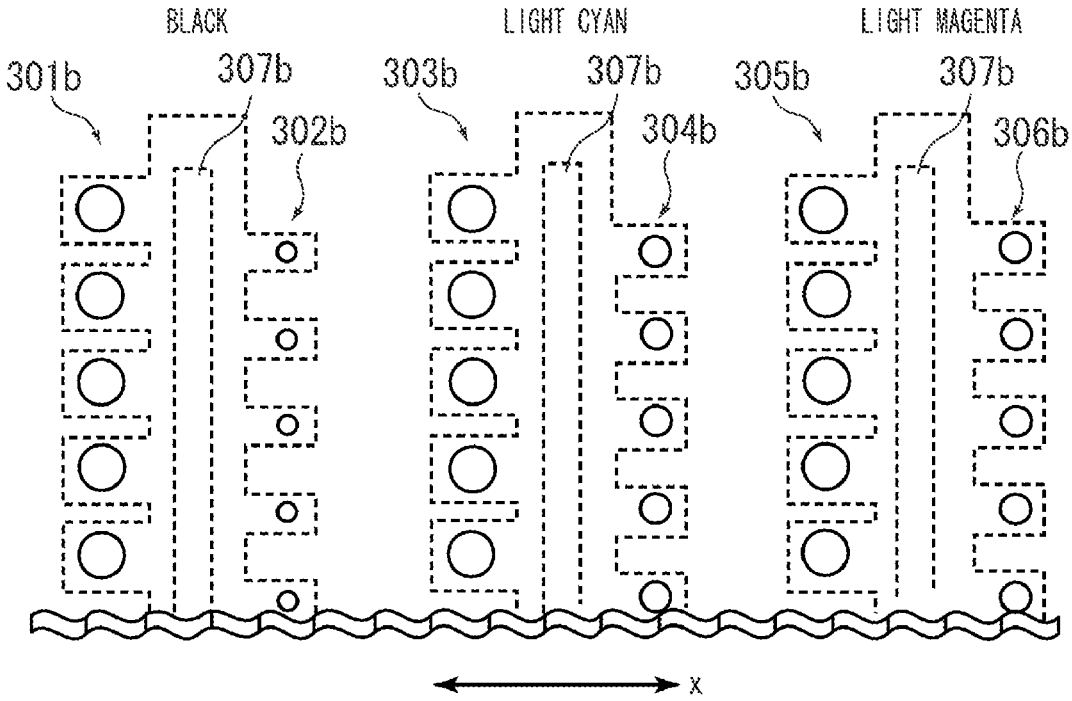
FIG. 12 illustrates a nozzle configuration of a recording head according to a second exemplary embodiment of the present invention.

A nozzle configuration of the photo-print recording head of the second exemplary embodiment includes, as shown in FIG. 12, a plurality of discharge ports aligned in rows along the main scan direction (X-direction). A first discharge port group 301*b* and a second discharge port group 302*b* oppose each other, a third discharge port group 303*b* and a fourth discharge port group 304*b* oppose each other, and a fifth discharge port group 305*b* and a sixth discharge port group 306*b* oppose each other, with each group pair sandwiching an ink supply port 307*b* therebetween. The discharge ports of the first discharge port group 301*b* and the second discharge port group 302*b* discharge black ink. The discharge ports of the third discharge port group 303*b* and the fourth discharge port group 304*b* discharge light cyan ink. The discharge ports of the fifth discharge port group 305*b* and the sixth discharge port group 306*b* discharge light magenta ink.

The first discharge port group 301*b*, the third discharge port group 303*b*, and the fifth discharge port group 305*b* include large-diameter discharge ports disposed at regular intervals. According to the second exemplary embodiment, the large discharge port has a diameter of about 23 μm and discharges approximately 10 pl.

The second discharge port group 302*b* include small-diameter discharge ports disposed at regular intervals. The small discharge port has a diameter of about 11.5 μm and discharges approximately 2 pl.

The fourth discharge port group 304*b* and the sixth discharge port group 306*b* include middle discharge ports smaller than the large discharge port but larger than the small discharge port. The middle discharge port is disposed at regular intervals. The middle discharge port is designed for a light cyan and a light magenta ink, both being a relatively brighter ink than a black ink. The middle discharge port has a diameter of about 16.5 μm and discharges approximately 5 pl. In the present case, the size of the discharge port is compared by using the discharge port diameter, but the discharge port area can alternatively be used for comparison.

The recording head of the second exemplary embodiment assigns the light cyan and the light magenta inks to the middle discharge port since both of them have lower probability of producing a grainy image than the black ink. Here, the middle discharge port is larger than the small discharge port for the black ink but smaller than the large discharge port for the black ink.

The reason for assigning the light cyan and the light magenta inks to the middle discharge port instead of the large discharge port is because light cyan and light magenta inks have lower dye density than inks of other colors. Accordingly, even if the dot size is the same on a recording medium, probability of producing a grainy image will be relatively low. If the amount of discharge of the light cyan and light magenta inks is the same as that discharged from the large discharge port, it can produce a grainy image. The middle discharge port which does not have the grainy effect on the image is therefore selected.

A reason for assigning the middle discharge port, instead of the small discharge port, to light cyan and light magenta inks is because middle-size dots discharged from the middle discharge port can cover an area with a smaller number of dots than those discharged from the small discharge port. According to the second exemplary embodiment, light cyan and light magenta inks are assigned to a middle discharge port that discharges 5 pl, so the number of necessary dots for both ink colors will be half of that discharged from a small discharge port that discharges 2 pl. This means that the number of times the heating devices for light cyan and light magenta inks are heated can be reduced to half, which contributes to preventing head temperature rise.

Since the amount of ink mist increases while the discharge amount decreases, the recording head of the second exemplary embodiment assigns the middle discharge port to light cyan and light magenta inks to reduce ink mist. This reduces the amount of mist that can adhere to the discharge port area of the recording head and other components of the printer body. Discharge failure and failure in the apparatus body can therefore be prevented.

As described above, by using the nozzle configuration of the second exemplary embodiment, the amount of ink mist can be reduced so as to prevent discharge failure or error in the apparatus body. In addition, with this configuration, a smaller number of dots will be required in printing an image as compared to the case where the same image is printed by a conventional head. Therefore, the number of times the heating device is heated is reduced, temperature rise in the head is controlled, continuous stable ink discharge becomes possible, and desirable print quality can be obtained. Further, since the number of dots required in printing an image is reduced, the number of times the heating device is turned on is reduced. This contributes to preventing a non-discharge of ink caused by a broken wire. Therefore, more prints can be produced by a recording head.

Third Exemplary Embodiment

The third exemplary embodiment describes a gray-color-print recording head having a configuration similar to the photo-print recording head described in the second exemplary embodiment but using a different type of ink in the ink cartridge. The description of the parts that are common to the above-mentioned exemplary embodiment is omitted for simplification.

Figure 13:
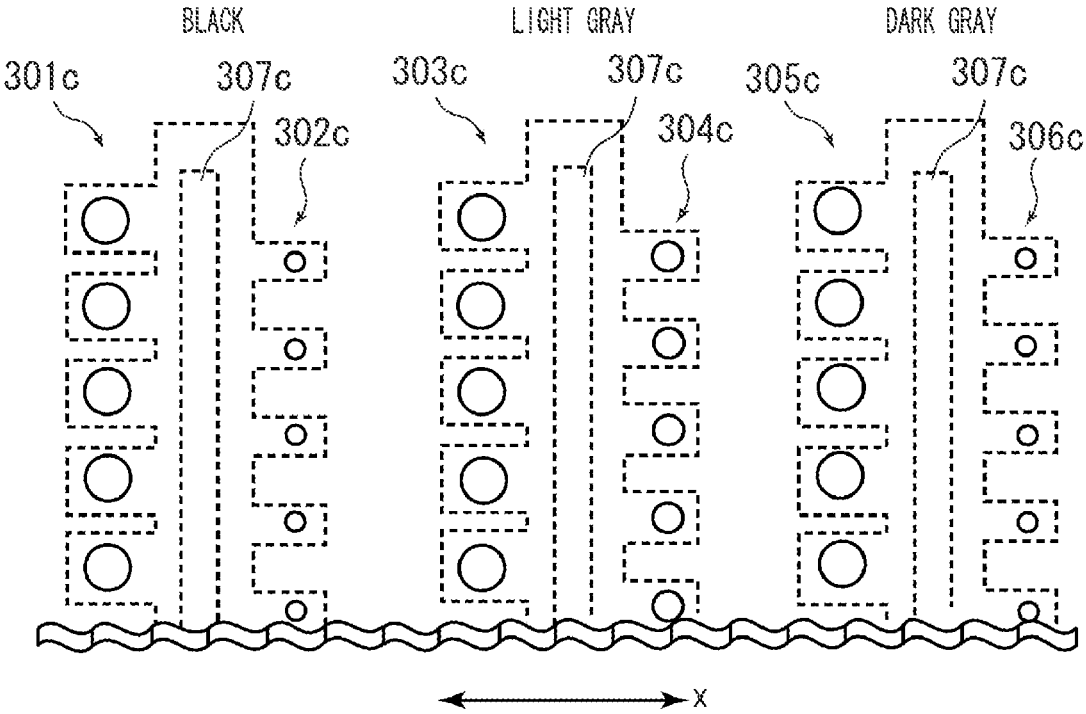
FIG. 13 illustrates a nozzle configuration of a recording head according to a third exemplary embodiment of the present invention.

A gray-color-print recording head is generally mounted on a printer body together with the recording heads for color-print and photo-print so that still further high-definition image with little grainy effect can be printed. In addition to the two mounting positions on the carriage 102 shown in FIG. 9, a third recording head mounting position is provided for gray-color printing. A black ink, a gray ink with reduced dye-density (hereinafter called "dark gray ink"), and a light gray ink with its dye-density further reduced are contained in the ink cartridge for the gray-color-printing A nozzle configuration of the gray-color-print recording head of the third exemplary embodiment has, as shown in FIG. 13, a plurality of discharge ports aligned in rows along the main scan direction (X-direction). A first discharge port group 301*c* and a second discharge port group 302*c* oppose each other, a third discharge port group 303*c* and a fourth discharge port group 304*c* oppose each other, and a fifth discharge port group 305*c* and a sixth discharge port group 306*c* oppose each other, with each group pair sandwiching an ink supply port 307*c* therebetween. The discharge ports of the first discharge port group 301*c* and the second discharge port group 302*c* discharge black ink. The discharge ports of the third discharge port group 303*c* and the fourth discharge port group 304*c* discharge light gray ink. The discharge ports of the fifth discharge port group 305*c* and the sixth discharge port group 306*b* discharge dark gray ink.

The first discharge port group 301*c*, the third discharge port group 303*c*, and the fifth discharge port group 305*c*, all of which have large diameter discharge ports, are disposed at regular intervals. According to the third exemplary embodiment, the large discharge port has a diameter of about 23 μm and discharges approximately 10 pl.

The second discharge port group 302*c* and the sixth discharge group 306*c* have small diameter discharge ports disposed at regular intervals. The small discharge port has a diameter of about 11.5 μm and discharges approximately 2 pl.

The fourth discharge port group 304*c* includes middle discharge ports smaller than the large discharge port but larger than the small discharge port. The middle discharge ports are disposed at regular intervals. The middle discharge port is designed for a light gray ink, which is a relatively brighter ink than a black ink or a dark gray ink. The middle discharge port has a diameter of about 16.5 μm and discharges approximately 5 pl.

The recording head of the third exemplary embodiment assigns the light gray ink to the middle discharge port, which shows less probability of producing a grainy image than the black ink or the dark gray ink for the following reasons.

The light gray ink is assigned to the middle discharge port instead of the large discharge port because light gray ink has lower dye density than other colors, and even if the dot size is the same on a recording medium, probability of producing a grainy image will be relatively low. Accordingly, the discharge port for the light gray is assigned to the middle discharge port which has the little grainy effect on the image.

Another reason for assigning the middle discharge port, instead of the small discharge port, to light gray ink is because middle-size dots discharged from the middle discharge port can cover an area with a smaller number of dots than small dots discharged from the small discharge port. According to the second exemplary embodiment, light gray ink discharged from a middle discharge port is 5 pl, so the required number of dots will be half of that discharged from a small discharge port which discharges 2 pl. This means that the number of times the heating device for light gray ink is heated can be reduced to half, which prevents head temperature rise.

Since the amount of ink mist increases while the discharge amount decreases, the recording head of the third exemplary embodiment assigns the middle discharge port to light gray ink to reduce ink mist. By using the nozzle configuration of the third exemplary embodiment, the amount of ink mist can be reduced. This reduces the amount of mist that can attach to the discharge port of the recording head and also other components of the printer body. Discharge failure and error in the apparatus body can therefore be prevented.

As described above, by using the nozzle configuration of the third exemplary embodiment that includes a gray-color-print recording head, an effect similar to the aforementioned embodiments can be obtained. In other words, since the amount of ink mist can be reduced as compared to the conventional head, discharge failure and error in an apparatus body can be prevented. Also, the number of discharged dots can be reduced, temperature rise in head temperature is controlled, continuous stable ink discharging is obtained, and desirable print quality can be achieved without sacrificing print speed.

Although each of the above-described exemplary embodiments employs discharge ports of different sizes to obtain a desired amount of discharge, different measures can also be taken.

Fourth Exemplary Embodiment

The fourth exemplary embodiment changes a discharge amount by modulating a pulse width applied to an electrothermal conversion element.

According to the fourth exemplary embodiment, a large-discharge-amount nozzle and a middle-discharge-amount nozzle have a same discharge port diameter. The drive pulse width of an electrothermal conversion element for a middle-discharge-amount port, however, is shorter than that for a large-discharge-amount port. In this manner, a discharge amount smaller than the large discharge amount can be obtained. Consequently, even if the diameter of the middle-discharge-amount port is the same as that for the large-discharge-amount port, a desirable middle discharge amount can be obtained by controlling the pulse width (see FIG. 14A), and an effect similar to the above-described exemplary embodiments can be obtained.

Figure 14B:
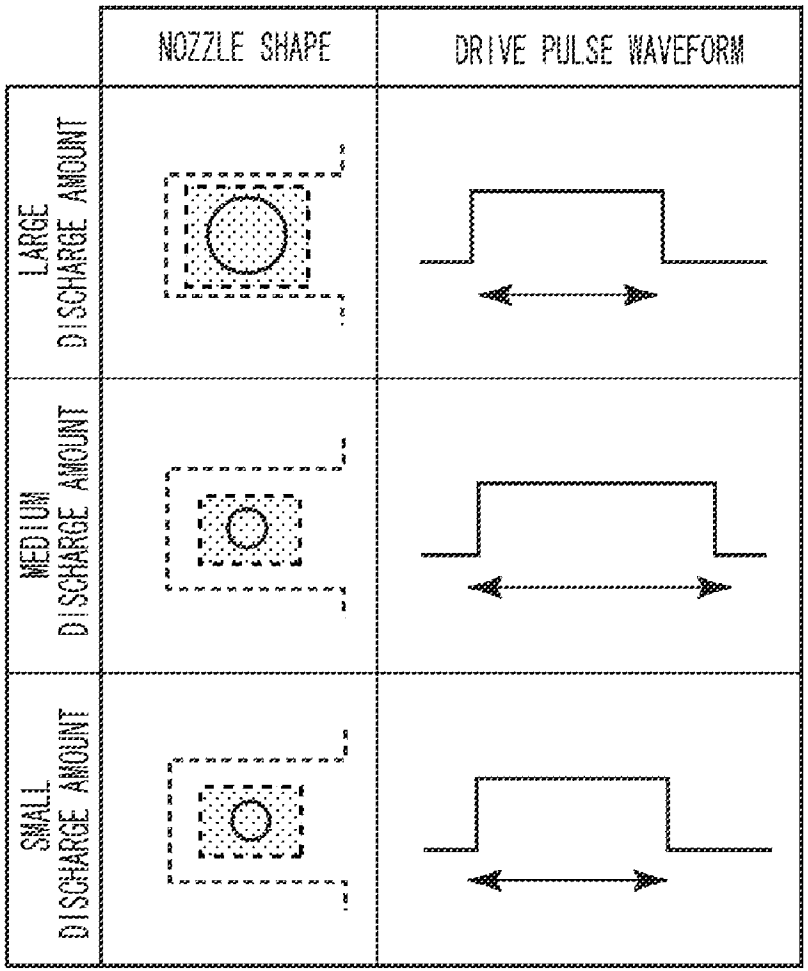
FIGS. 14A and 14B show a relationship between nozzle size of a recording head and drive pulse waveform according to a fourth exemplary embodiment of the present invention.
Figure 14A:
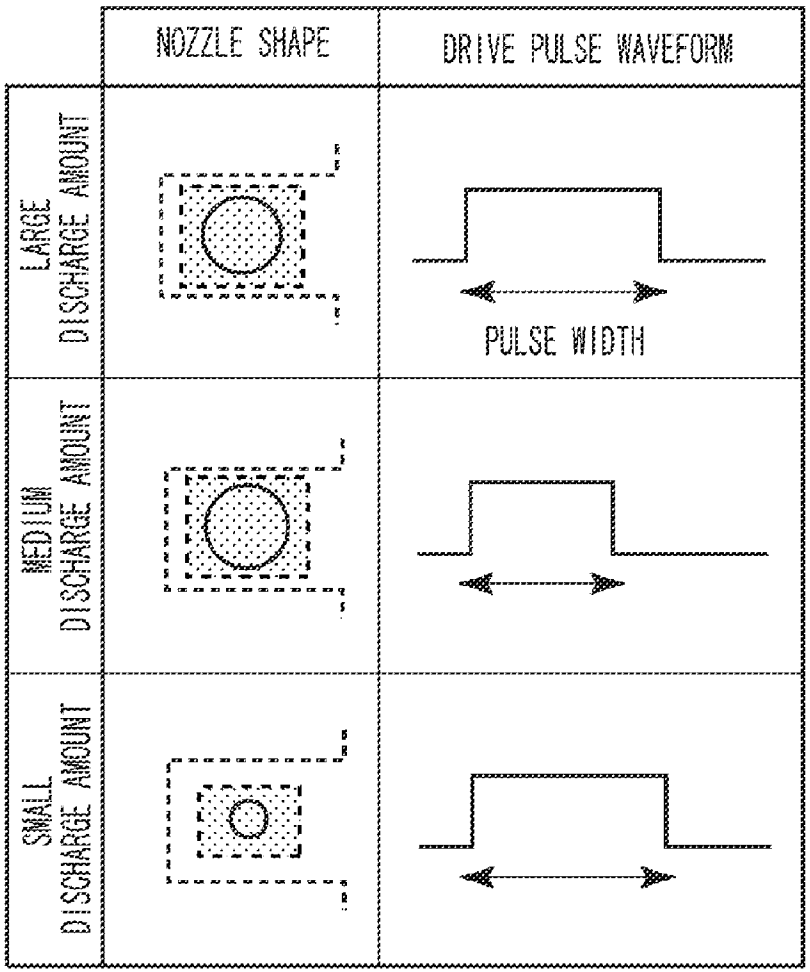

Further, a middle-discharge-amount nozzle that has a same discharge port diameter as a small-discharge-amount nozzle but has a longer drive pulse width for the electrothermal conversion, is capable of discharging a middle amount of discharge (see FIG. 14B). Also in this case, an effect similar to the above-described embodiments can be obtained.

Fifth Exemplary Embodiment

The fifth exemplary embodiment controls a discharge amount by changing a size of an electrothermal conversion element.

Figure 15A:
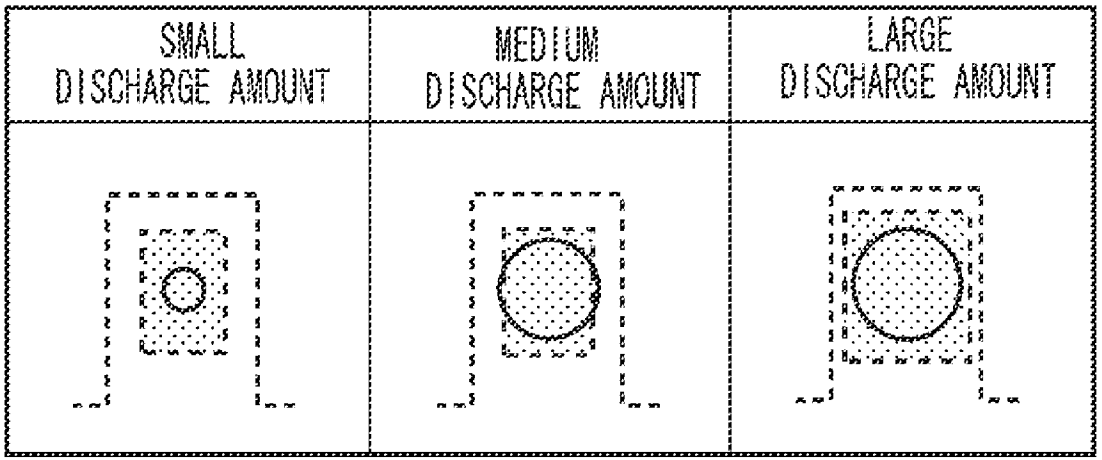
FIGS. 15A and 15B show a relationship between discharge port arrangement of a recording head and electrothermal transducer according to a fifth exemplary embodiment of the present invention.

According to the fifth exemplary embodiment, a large-discharge-amount nozzle and a middle-discharge-amount nozzle have a same discharge port diameter. The size of an electrothermal conversion element for a middle-discharge-amount port, however, is smaller than that for a large-discharge-amount port. Also in this manner, a discharge amount smaller than the large discharge amount can be obtained. Consequently, even if the diameter of the middle-discharge-amount port is the same as that for the large-discharge-amount port, a desirable middle discharge amount can be obtained by controlling the size of the electrothermal conversion element (see FIG. 15A), and an effect similar to the above-described exemplary embodiments can be obtained.

Figure 15B:
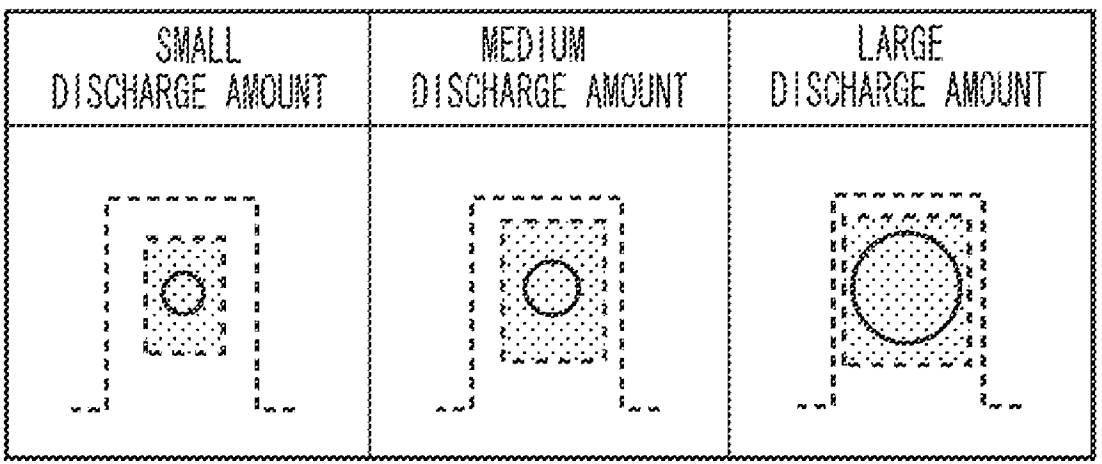

Further, a middle-discharge-amount nozzle that has a same discharge port diameter as a small-discharging-amount nozzle but has a larger electrothermal conversion element is capable of discharging a middle amount of discharge (see FIG. 15B). Also in this case, an effect similar to the above-described embodiments can be obtained.

Sixth Exemplary Embodiment

The sixth exemplary embodiment controls a discharge amount by changing a taper angle of a nozzle toward a discharge port.

Figure 16A:
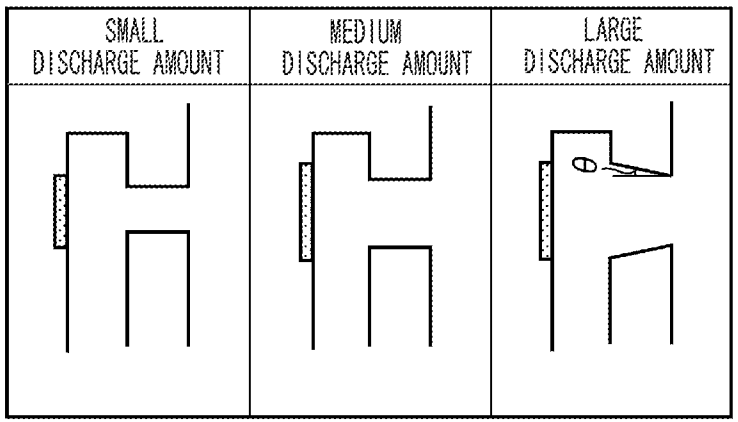
FIGS. 16A and 16B illustrate a cross section of a recording head nozzle according to a sixth exemplary embodiment of the present invention.

According to the sixth exemplary embodiment, a large-discharge-amount nozzle and a middle-discharge-amount nozzle have a same discharge port diameter. However, while the middle-discharge-amount nozzle is not tapered, the large-discharge-amount nozzle is tapered toward the discharge port (see FIG. 16A). Consequently, even if the diameters of the discharge ports are the same, a desirable middle discharge amount can be obtained by controlling the taper angle. Also in this case, an effect similar to the above-described exemplary embodiments can be obtained.

Figure 16B:
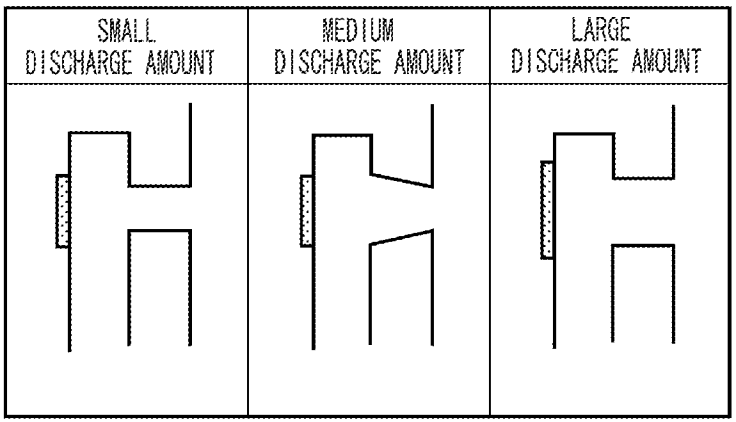
Figure 17:
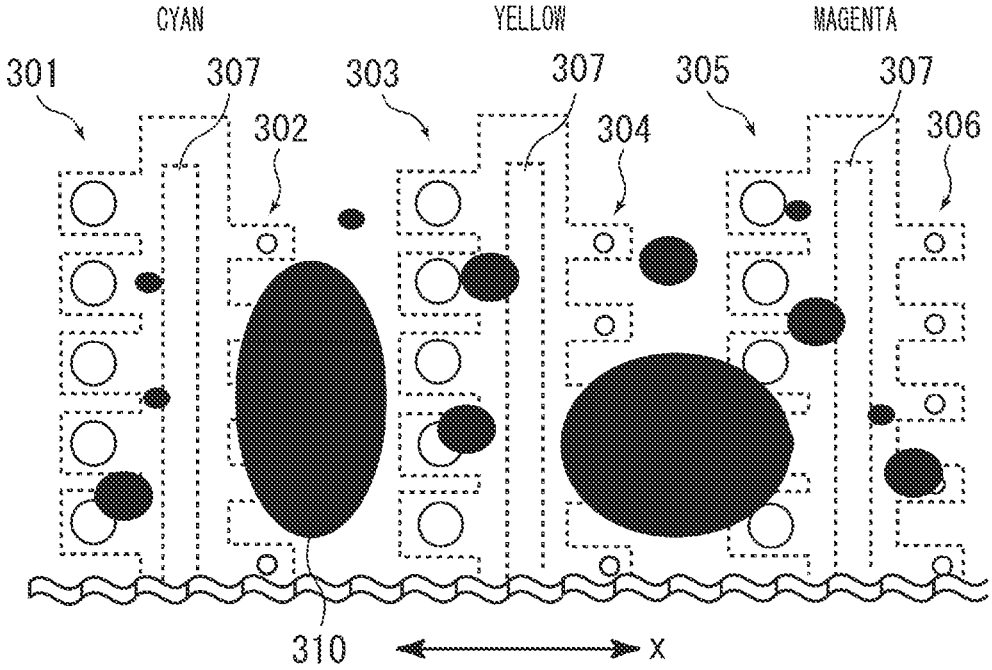
FIG. 17 (PRIOR ART)
FIG. 17 illustrates an accumulated ink pool produced by ink mist adhering to a discharge port of a recording head.
Figure 18:
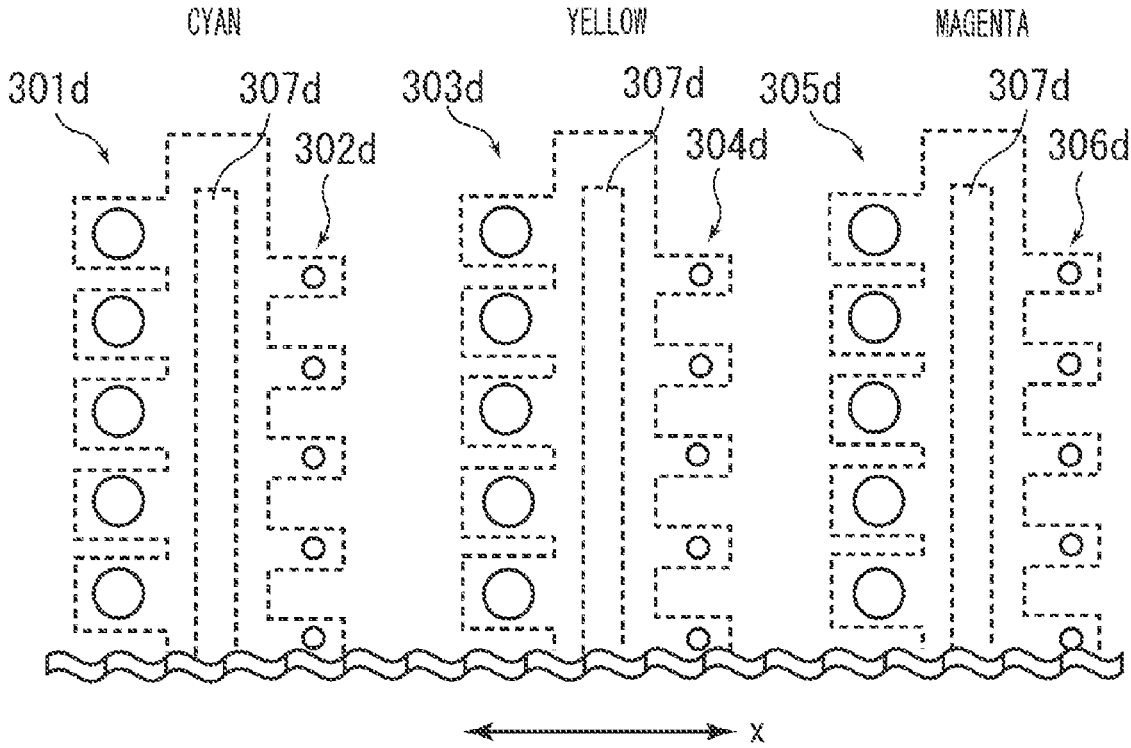
FIG. 18 (PRIOR ART)
FIG. 18 illustrates a nozzle configuration of a conventional recording head.
Figure 19:
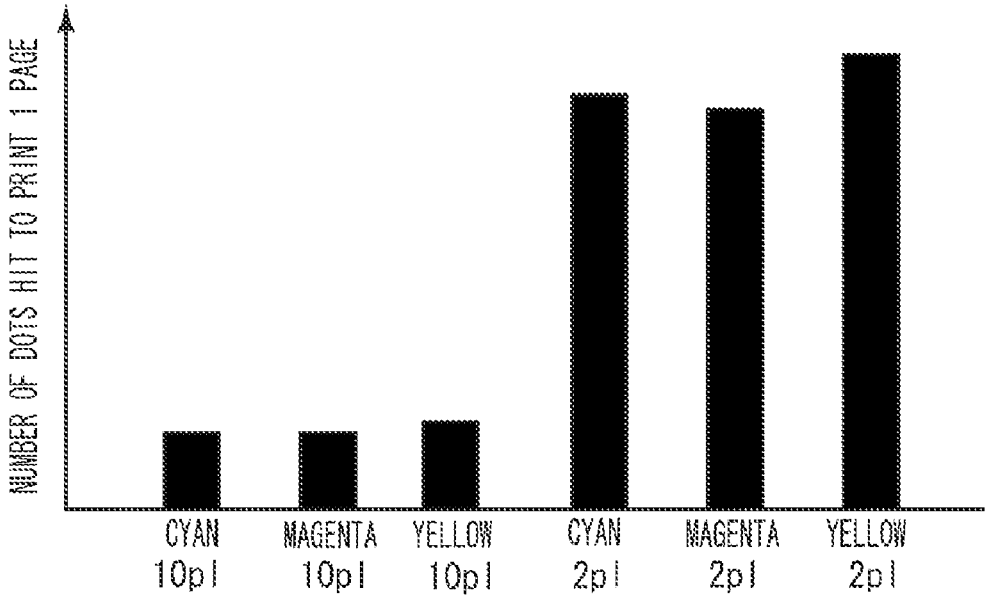
FIG. 19 (PRIOR ART)
FIG. 19 shows number of dots discharged from each discharge port group to print one page.

Further, while a large-discharge-amount nozzle and a middle-discharge-amount nozzle have a same discharge port diameter, a middle-discharge-amount nozzle that has a taper toward the discharge port is capable of discharging a middle amount. The small-discharge-amount nozzle is not tapered. A desirable middle discharge amount can be obtained by controlling the size of the taper angle (see FIG. 16B). Also in this case, an effect similar to the above-described embodiments can be obtained.

While the presence of a taper in each nozzle is discussed in the sixth exemplary embodiment, all of the nozzles can also be tapered. In this case, a nozzle discharging a larger amount of ink will have a greater taper angle (e.g., angle θ of FIG. 16A).

It is to be noted that a combination of the above-mentioned exemplary embodiments can also be applied to the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2005-344367 filed Nov. 29, 2005, which is hereby incorporated by reference herein in its entirety.

What is claimed is:

1. An ink jet recording head configured to perform recording by discharging at least two types of ink onto a recording medium while scanning the recording medium, comprising:

a first discharge port group and a second discharge port group each arranged in a row and configured to discharge a first ink; and a third discharge port group and a fourth discharge port group configured to discharge a second ink of a type different from the first ink;

wherein the fourth discharge port group discharges a minimum amount of the second ink and the third discharge port group discharges a maximum amount of the second ink, wherein the second discharge port group discharges a minimum amount of the first ink and the first discharge port group discharges a maximum amount of the first ink, wherein the fourth discharge port group discharges from each discharge port an amount of ink at a time that is smaller than from each discharge port of the first discharge port group, and discharges an amount of ink at a time that is larger than from each discharge port of the second discharge port group, and wherein the second ink has the brightest color value among the inks to be discharged from the ink jet recording head.

2. The ink jet recording head according to claim 1, further comprising a fifth discharge port group and a sixth discharge port group each configured to discharge a third ink different from either the first ink or the second ink, wherein the fifth discharge group discharges from each discharge port an amount of ink at a time that is substantially the same as from each discharge port of the first discharge group, and the sixth discharge group discharges from each discharge port an amount of ink at a time that is substantially the same as from each discharge port of the second discharge group.

3. The ink jet recording head according to claim 2, wherein one of the first ink and the third ink is a cyan ink and the other one is a magenta ink, and the second ink is a yellow ink.

4. The ink jet recording head according to claim 1, further comprising a fifth discharge port group and a sixth discharge port group configured to discharge a third ink different from either the first ink or the second ink, wherein the sixth discharge port group discharges from each discharge port an amount of ink at a time that is smaller than from each discharge port of the fifth discharge port group, the sixth discharge port group discharges from each discharge port an amount of ink at a time that is smaller than from each discharge port of the first discharge port group, and discharges from each discharge port an amount of ink at a time that is larger than from each discharge port of the second discharge port group.

5. The ink jet recording head according to claim 4, wherein one of the second ink or the third ink is a light cyan ink and the other one is a light magenta ink, and the first ink is a black ink or a gray ink.

6. The ink jet recording head according to claim 1, wherein between the third discharge port group and the fourth discharge port group, a discharge port area of the one of the third and fourth discharge port groups which discharge a smaller amount of ink at a time from a single discharge port, is smaller than a discharge port area of the first discharge port group, and larger than a discharge port area of the second discharge port group.

7. The ink jet recording apparatus incorporating an ink jet recording head according to claim 1, comprising a conveying unit configured to convey the recording medium; and a carriage configured to carry the ink jet recording head in a scanning manner.

* * * * *